US008224490B2

(12) United States Patent
Knyazev

(10) Patent No.: US 8,224,490 B2
(45) Date of Patent: Jul. 17, 2012

(54) SYSTEM FOR CONTROLLING THE HEATING AND HOUSING UNITS IN A BUILDING

(76) Inventor: Dmitriy Knyazev, Windsor (CA)

( * ) Notice: Subject to any disclaimer, the term of this patent is extended or adjusted under 35 U.S.C. 154(b) by 321 days.

(21) Appl. No.: 12/470,181

(22) Filed: May 21, 2009

(65) Prior Publication Data

US 2010/0298992 A1 Nov. 25, 2010

(51) Int. Cl.
*G05D 23/00* (2006.01)

(52) U.S. Cl. ..... 700/276; 700/277; 700/278; 700/300

(58) Field of Classification Search ..... 700/276, 700/277, 278, 299, 300; 236/46 R, 91 R
See application file for complete search history.

(56) References Cited

U.S. PATENT DOCUMENTS 4,176,785 A * 12/1979 Allard et al. ..... 236/46 R
4,217,646 A * 8/1980 Caltagirone et al. ..... 700/296
4,354,241 A * 10/1982 Barello ..... 700/276
4,396,148 A * 8/1983 Masson ..... 236/46 R
5,105,366 A * 4/1992 Beckey ..... 700/276
5,123,254 A * 6/1992 Inoue et al. ..... 62/126
6,735,964 B2 * 5/2004 Palmer et al. ..... 62/149
6,922,613 B2 * 7/2005 Park et al. ..... 700/276
7,024,283 B2 * 4/2006 Bicknell ..... 700/276
7,287,393 B2 * 10/2007 Kwon et al. ..... 62/157
7,542,824 B2 * 6/2009 Miki et al. ..... 700/291
7,789,317 B2 * 9/2010 Votaw et al. ..... 236/1 B
7,957,840 B2 * 6/2011 Sangenya et al. ..... 700/277
2001/0003906 A1 * 6/2001 Roh ..... 62/231
2009/0001179 A1 * 1/2009 Dempsey ..... 236/46 R
2009/0018705 A1 * 1/2009 Ouchi et al. ..... 700/291
2009/0182456 A1 * 7/2009 Liao et al. ..... 700/276
2009/0259342 A1 * 10/2009 Thomas et al. ..... 700/277
2010/0045470 A1 * 2/2010 Araiza et al. ..... 700/300

* cited by examiner

*Primary Examiner* — Charles Kasenge
(74) *Attorney, Agent, or Firm* — Elias Borges

(57) ABSTRACT

The present invention is a system for controlling the heating of a plurality of individual housing units in a building. The system includes at least one heating unit contained in each individual housing unit for heating said individual housing unit and a control unit coupled to each of the heating units for controlling the heat output of the control units. At least one outside temperature sensor is coupled to the control unit for providing the control unit with the measured temperature of the air outside the building. The control unit has an algorithm which is configured to decrease the heat output of the heating units when the temperature of the air outside the building increases beyond a predefined minimum outside temperature.

8 Claims, 2 Drawing Sheets

SYSTEM FOR CONTROLLING THE HEATING AND HOUSING UNITS IN A BUILDING

FIELD OF THE INVENTION

The invention relates generally to systems for controlling the heating of multi-unit dwelling buildings such as apartment buildings.

BACKGROUND OF THE INVENTION

Multi-unit dwelling buildings, such as apartment buildings, hotels, and condominium buildings, generally include a heating system for individually heating each of the dwelling units, or apartments. The heating system often employs a thermostat in each unit with which the unit's occupants can, to some extent, regulate the temperature in the unit. In theory, the occupants of the building raise or lower the thermostats in their units as desired in order to adjust the temperature to a comfortable level. In theory, those occupants desiring to keep their individual unit cooler would simply turn down their unit's thermostat to the desired temperature. In practice; however, occupants do not use the thermostat to regulate the temperature in their dwelling unit. In fact, in most cases, what occupants do is turn their unit's thermostats to maximum and then open and close windows to regulate the temperature inside their unit. As a result, a significant percentage of the energy used to heat the unit simply escapes through the windows. The net effect is that the energy required to heat the building is much higher than would be required if all of the building's occupants kept the windows of their respective units closed. Indeed, it is often the case that the energy consumed to heat an apartment building is actually higher in the months of April and May than in the months of January and February due to the fact that people are more likely to keep their windows open during the spring than during the coldest months of winter. A system is therefore required which ensures that the multi-unit residential building remains as energy efficient as possible.

SUMMARY OF THE INVENTION

In accordance with one aspect of the present invention, there is provided a system for controlling the heating of a plurality of individual housing units in a building which overcomes the drawbacks of the prior art. The system includes at least one heating unit contained in each individual housing unit for heating said individual housing unit. A control unit is coupled to each of the heating units, the control unit configured to control the heat output of the heating units. At least one outside temperature sensor is coupled to the control unit for providing the control unit with the measured temperature of the air outside the building. The control unit has an algorithm which is configured to decrease the heat output of the heating units when the temperature of the air outside the building increases beyond a predefined minimum outside temperature.

In accordance with another aspect of the present invention, there is provided a system for controlling the heating of a plurality of individual housing units in a building, the system including at least one heating unit contained in each individual housing unit and a relay coupled to each heating unit for turning the heating unit on and off. A control unit is coupled to each of the relays, the control unit configured to cause the relays to turn their respective heating units on and off in response to a duty cycle applied to the relay. The system further includes at least one outside temperature sensor coupled to the control unit for measuring the temperature of the air outside the building and transmitting same to the control unit. Finally, the control unit has an algorithm configured to decrease the duty cycle when the temperature of the air outside the building increases beyond a predefined minimum outside temperature.

In accordance with another aspect of the present invention, there is provided a system for controlling the heating of a plurality of individual housing units in a building, the individual housing units being contained in separate zones of the building. The system includes at least one heating unit contained in each individual housing unit for heating said individual housing unit and a relay coupled to each heating unit for turning the heating unit on and off. A control unit is coupled to each of the relays, the control unit configured to cause the relays to turn their respective heating units on and off in response to a duty cycle applied to the relay. The system further includes at least one outside temperature sensor coupled to the control unit for measuring the temperature of the air outside the building and at least one inside temperature sensor coupled to the control unit for measuring the temperature of the air inside each of the zones. The control unit has an algorithm configured to decrease the duty cycle when the temperature of the air outside the building increases beyond a predefined minimum outside temperature. The algorithm is further configured to increase the duty cycle of the heating units in the zones when the temperature of the air in said zones drops below a predefined inside minimum.

In accordance with another aspect of the present invention, there is provided a system for controlling the heating of a plurality of individual housing units in a building having a plurality of sides, the system including at least one heating unit contained in each individual housing unit coupled to a relay for turning the heating unit on and off. A control unit is coupled to each of the relays and is configured to cause the relays to turn their respective heating units on and off at a duty cycle. At least one outside temperature sensor is coupled to the control unit for measuring the temperature of the air outside the building and at least one outside wind sensor is coupled to the control unit for measuring the speed of the wind outside the building. The control unit has an algorithm configured to decrease the duty cycle when the temperature of the air outside the building increases beyond a predefined minimum outside temperature, and the algorithm being further configured to increase the duty cycle when the speed of the wind outside the building exceeds a predefined minimum wind speed.

In accordance with another aspect of the present invention, there is provided a system as described in the proceeding paragraph wherein a wind direction sensor is coupled to the control unit and wherein the algorithm is further configured to increase the duty cycle of the heaters in the units on the side of the building adjacent the wind direction and to lower the duty cycle of the heaters in the units on the side of the building opposite the wind direction.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention.

DESCRIPTION OF THE DRAWINGS

In the drawings like characters of reference indicate corresponding parts in the different figures.

DETAILED DESCRIPTION OF THE INVENTION

Figure 1:
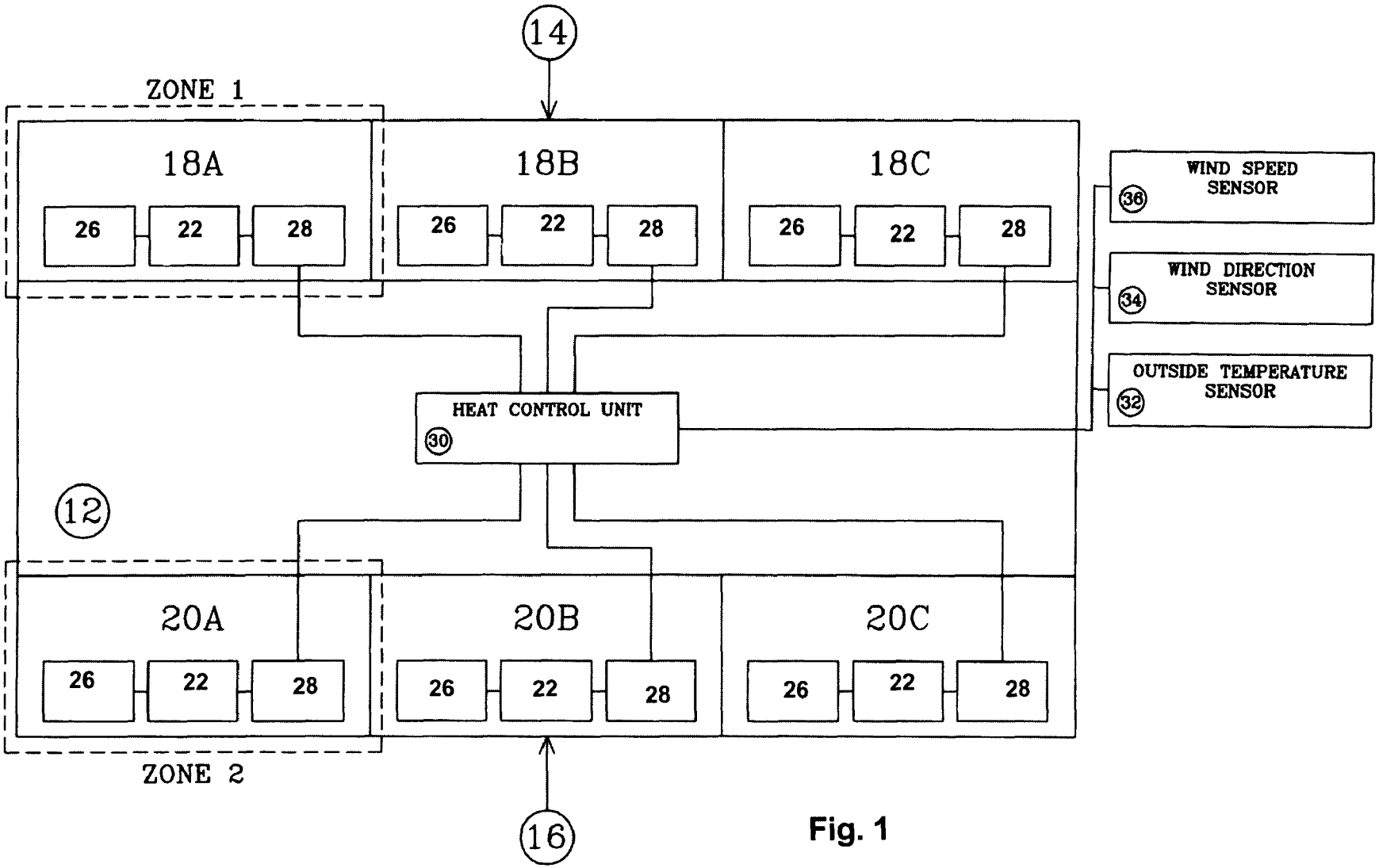
FIG. 1. is a schematic view of an apartment building incorporating the system of the present invention.

Referring firstly to FIG. 1, the present invention, shown generally as item 10, is a system for controlling the heating of a plurality of individual housing units 18*a*, 18*b*, 18*c*, 20*a*, 20*b* and 20*c* in a multi-unit building 12. Building 12 is preferably a multi-unit residential building such as an apartment building, hotel or condominium complex. Building 12 has opposite sides 14 and 16, with residential units 18*a*, 18*b* and 18*c* adjacent side 14 and residential units 20*a*, 20*b* and 20*c* adjacent side 16. Each residential unit has a heating unit 22 and a regulator 28 coupled to the heating unit for regulating the heat output of the heating unit. Each residential unit may also have a thermostat 26 which is coupled to heating unit 22 to provide an additional means of controlling the heat output of the heating unit. Regulators 28 are each coupled to control unit 30 which is adapted to operate the regulators to adjust the heat output of heaters 22. Control unit 30 is coupled to outside temperature sensor 32 which measures the temperature of the air outside building 12. Control unit 30 is also coupled to wind direction sensor 34 and wind speed sensor 36 which provide the control unit with the wind direction and speed of any wind which may be blowing against building 12, respectively. Control unit 30 is configured to lower or raise the heat output of heating units 22 as a function of the outside air temperature and as a function of the speed and direction of any wind acting on building 12.

Heating units 22 are preferably electric heating units such as standard electric base board heaters. Alternatively, heating units 22 could be hot water radiators or even steam radiators. If heaters 22 consist of electric heating units, then regulators 28 are preferably solid state relays which are adapted to turn the heating units on or off in a sequential pattern (i.e. duty cycle). Solid state relays suitable for use as regulators 28 are readily available on the market. If heaters 22 consist of hot water or steam radiators, then regulars 28 would preferably be solenoid valves which control the flow of hot water or steam to the radiators. Solenoid valves capable of controlling the flow of hot water or steam are readily available in the market.

Control unit 30 preferably consists of a Programmable Logic Controller (PLC) which is configured to be programmed with an algorithm (not shown) which is configured to cause the PLC to operate regulators 28 such that heating units 22 decrease their heat output when the temperature of the air outside building 12 as measured by sensor 32 increases beyond a predefined minimum outside temperature. The algorithm is further configured to decrease the heat output of the heating units to zero when the outside air temperature exceeds a predefined maximum outside temperature. Preferably, the algorithm is further configured to decrease the heat output of the heating units proportionally to the rise in the temperature of the air outside the building. The algorithm is also configured to increase the heat output of the heating units when the temperature outside the building decreases below the predefined maximum outside temperature. The algorithm is further configured to adjust the heat output of the heating units in response to the speed and direction of the wind acting on the building. In particular, the algorithm is configured to increase the heat output of the heating units if the airspeed of wind outside the building exceeds a predefined minimum wind speed. The algorithm may be further configured to increase the heat output of the heaters in the residential units adjacent the side of the building upon which the wind is impinging, namely in residential units 18*a*, 18*b* and 18*c* and to decrease the heat output of the heaters in the residential units adjacent the opposite side of the building, namely in residential units 20*a*, 20*b* and 20*c*.

Figure 2:
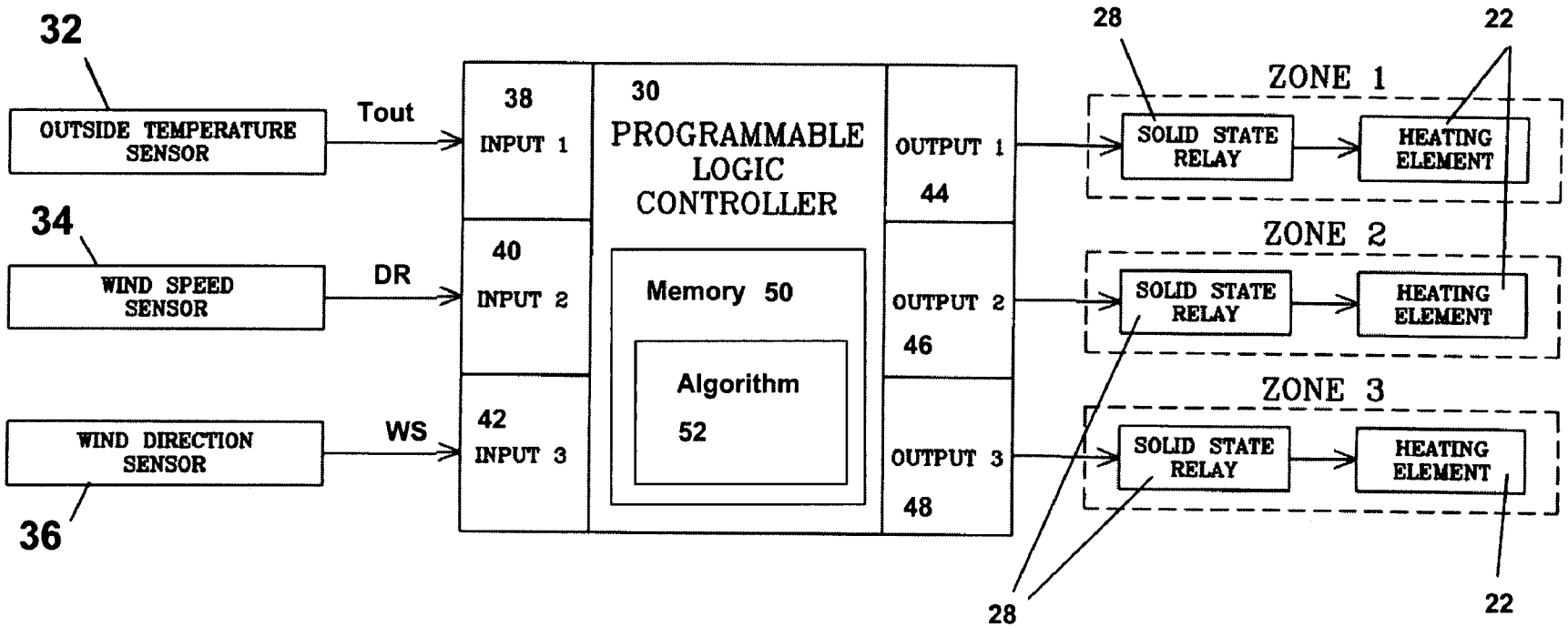
FIG. 2 is a schematic view of the PLC component of the present invention coupled to the heaters in different zones of an apartment building incorporating the system of the present invention.

FIG. 2 shows a typical PLC control unit 30 which is configured for use in the system of the present invention. PLC 30 includes inputs 38, 40 and 42 and outputs 44, 46 and 48. Inputs 38, 40 and 42 are coupled to temperature sensor 32, wind direction sensor 34 and wind speed sensor 36, respectively. Outputs 44, 46 and 48 are coupled to regulators 28 located in the residential units of zone 1, zone 2 and zone 3, respectively. Preferably, PLC control unit 30 will have an output for each regulator 28; however, for the purposes of this application, we will consider a PLC control unit with only three outputs. Also, for the purpose of this application we shall assume that heating units 22 consist of electric baseboard heaters and regulators 28 consist of solid state relays. In this arrangement, PLC 30 is configured to turn relays 28 on and off sequentially in a duty cycle. A duty cycle is generally defined as the proportion of time during which a component (in this case the relay and the heating unit coupled to the relay) is operated during a time period. If the duty cycle is 1, then the heating unit is operating for the entire time period. If the duty cycle is 0, then the heating unit is off for the entire time period. If the duty cycle is 0.6, then the heater is operating for 60% of the time period. For example, if the duty cycle is 0.3 and the time period is 100 seconds, then the heater would be cycled on for 30 seconds, then off for 70 seconds for each 100 second time period. PLC units suitable for use in the system of the present invention are readily available from manufactures such as Siemens™, GE Fenuk™, Honeywell™, Mitsubishi™ and the like.

PLC 30 has a memory module 50 wherein is contained algorithm 52. Algorithm 52 is essentially a computer program which has been designed to adjust the duty cycle signals produced at outputs 44, 46 and 48 in response to data received at inputs 38, 40 and 42. Temperature sensor 32 is configured to send an outside temperature reading (Tout) to PLC input 38 corresponding to the temperature of the outside air as measured by sensor 32. Preferably temperature sensor 32 comprises a thermo couple of the type generally available in the market for use with PLC control units. Likewise, wind direction sensor 34 is configured to send a wind direction reading (DR) to PLC input 40 corresponding to the direction of the wind measured by sensor 34 and wind speed sensor 36 is configured to send a wind speed reading (WS) to PLC input 42 corresponding to wind speed measured by sensor 36. Wind speed sensor 36 may comprise an electronic (digital or analog) anemometer and wind direction sensor 34 may comprise an electronic (digital or analog) wind vane. Suitable anemometers and wind vanes are available on the market. Sensors 34 and 36 may be separate devices, or they may be a single sensing device capable of producing both a wind speed and wind direction reading. Ultrasonic anemometers are available on the market which have the ability to accurately measure both speed and direction very accurately.

Algorithm 52 is programmed with a set of predefined parameters, namely the minimum outside temperature ($T_{OutMIN}$), maximum outside temperature ($T_{OutMAX}$), minimum wind speed ($WS_{MIN}$) and the rate by which the duty cycle of each heating unit is altered as a result in changes in Tout, DR and WS relative to these predefined parameters. Each of these predefined parameters would have to be customized for each application of the system, since the thermal dynamics of each building and possibly each residential unit in a given building, may be different. Principally, the algorithm is designed to ensure that the heating units inside each of the residential units are operating to produce enough heat output to keep the temperature inside each of the residential units near an optimal comfortable temperature ($T_{OP}$) provided all of the windows in the residential units remain closed. The following table illustrates some possible values for $T_{OP}$, $T_{OutMAX}$, $T_{OutMIN}$, $WS_{MIN}$ together with the corresponding duty cycle or change in duty cycle for a hypothetical multi-unit residential building incorporating the system of the present invention.

TABLE 1

| $T_{OP}$ | $T_{OutMAX}$ | $T_{OutMIN}$ | $WS_{MIN}$ |
|---|---|---|---|
| 25° C. | 20° C. | −20° C. | 5 km/s |

Algorithm 52 of PLC 30 is configured to decrease the heat output of the heating units in the residential units as the outside temperature increases from $T_{OutMIN}$ towards $T_{OutMAX}$. At $T_{OutMAX}$ the heat output from the heaters should be dropped down to zero. The temperatures of the apartment units should remain close to $T_{OP}$ as a result of the latent heat in the building as well as the day to day heat generating activities occur in the building—such as cooking and cleaning. To accomplish this, the algorithm is provided with (or otherwise incorporates) a table or formula which adjusts the duty cycle applied to the outputs as a function of the measured $T_{Out}$ in order to kept the inside temperature of the apartment units at or near $T_{OP}$. The following table illustrates one possible relationship between $T_{out}$ and the duty cycle applied to heaters 22 in units 18*a* and 20*a* given the above values for $T_{OP}$, $T_{OutMAX}$ and $T_{OutMIN}$.

TABLE 2

| Tout | Duty Cycle for Unit 18a | Duty Cycle for Unit 20a |
|---|---|---|
| −20 C. | 1.0 | 1.0 |
| −15 C. | 0.9 | 0.9 |
| −10 C. | 0.8 | 0.8 |
| −5 C. | 0.5 | 0.6 |
| 0 C. | 0.4 | 0.5 |
| 5 C. | 0.3 | 0.4 |
| 10 C. | 0.2 | 0.3 |
| 15 C. | 0.1 | 0.1 |
| 20 C. | 0.0 | 0.0 |

As can be seen from table 2, as the temperature outside the building increases, the duty cycle applied at the outputs of the PLC decreases and, as a result, the heat output of the heaters decreases. Likewise, as the temperature outside the building decreases, the duty cycle applied at the outputs of the PLC increases, and as a result, the heat output of the heaters increases. This is advantageous because, due to the thermal properties of the building, and the heaters in the building, it can take some time for the temperature in the building to be adjusted. Hence, if it suddenly becomes quite cold outside the building, the heat output of the heaters is increased early so that the residential units do not become too cold and remain at or near $T_{op}$. Prior art heat management systems used temperature sensors inside the residential building to trigger an increase in the heat output of the heaters; which necessarily means that the temperature inside the building must drop below $T_{op}$.

It is also apparent from table 2 that changes in outside temperature do not necessarily result in the equal increase or decrease in the heat output of the heating units in all the residential units. It will be appreciated that, due to the thermal properties of the building, some residential units are more prone to cooling than other units. It is possible that some units have less insulation, or larger heating units, or the like which make it necessary to adjust the duty cycle of different units differently as the temperature changes.

The data in table 2 can be generated either using mathematical models or by simple trial and error. Indeed, the data can be generated for any given outside temperature simply adjusting the duty cycle of the heating units to ensure that the inside temperature of each unit remains steady at $T_{op}$. Thermal imaging cameras can also be used to see which residential units lose more or less heat, and therefore, which heating units should have larger or smaller duty cycles.

As mentioned previously, the algorithm is further configured to increase the duty cycle applied to various heating units depending on the speed and direction of the wind. It is well understood that strong winds can have a wind chill effect on a building, requiring a greater heat output from the heaters. The algorithm is further configured to increase the duty cycle applied to the heaters in the residential units facing the wind and to actually decrease the duty cycle applied to the heaters in the residential units on the side opposite the wind. The following table (table 3) illustrates some duty cycles as relates to wind speed and direction.

TABLE 3

| Wind Direction | Wind Speed | Duty Cycle change at 18a (North side of building) | Duty Cycle change at 20a (South side of building) |
|---|---|---|---|
| North | >5 km/hr | +0.1 | −0.1 |
| North | >10 km/hr | +0.2 | −0.2 |
| North | >20 km/hr | +0.3 | −0.3 |
| South | >5 km/hr | −0.1 | +0.1 |
| South | >10 km/hr | −0.2 | +0.2 |
| South | >20 km/hr | −0.3 | +0.3 |

Residential units 18*a* and 20*a* are located in zones 1 and 2, respectively; therefore, outputs 44 and 46 are coupled to regulators 28 in residential units 18*a* and 20*a*, respectively. If the data of table 3 is incorporated into the algorithm, then as the wind speed increases above 5 km/hr from the North, the duty cycle from output 44 increase by 0.1 and the duty cycle from output 46 decreased by 0.1. Hence, if the outside temperature was −10° C., then applying the algorithm as summarized in tables 2 and 3 would set the duty cycle at output 44 to 0.9 and at output 46 to 0.7. Essentially, what this does is cause the heaters in the residential units on the north side of building to a output more heat while causing the heaters on the south side of the building to output less heat. It will be appreciated that heat flows between units in any residential building, hence increasing the heat output on just one side of the building will cause all of the units to gradually increase in temperature. By decreasing the heat output on the units on the side of the building opposite the wind, the temperature of all of the residential units remains at close to the optimal temperature.

A specific embodiment of the present invention has been disclosed; however, several variations of the disclosed embodiment could be envisioned as within the scope of this invention. It is to be understood that the present invention is not limited to the embodiments described above, but encompasses any and all embodiments within the scope of the following claims.

Therefore, what is claimed is:

1. A system for controlling the heating of a plurality of individual housing units in a building, the system comprising:

at least one heating unit contained in each individual housing unit for heating said individual housing unit;

a relay coupled to each heating unit for turning the heating unit on and off;

a control unit coupled to each of the relays, the control unit configured to cause the relays to turn their respective heating units on and off at a duty cycle by applying the duty cycle to the relays;

at least one outside temperature sensor coupled to the control unit for measuring the temperature of the air outside the building;

the control unit having an algorithm configured to decrease the duty cycle on each relay when the temperature of the air outside the building increases beyond a predefined minimum outside temperature;

the control unit being configured to simultaneously apply different duty cycles to different relays, and, the algorithm being further configured to change the duty cycle on some of the relays more than on other of the relays depending on the temperature of the air outside the building.

2. The system of claim 1 wherein the algorithm is further configured to decrease the duty cycle from 1 to 0 when the temperature of the air outside the building increases from below the predefined minimum outside temperature to above a predefined maximum outside temperature.

3. The system of claim 2 wherein the algorithm is further configured to decrease the duty cycle proportionally to the rise in the temperature of the air outside the building.

4. The system of claim 2 wherein the algorithm is further configured to increase the duty cycle when the temperature of the air outside the building decreases below the predefined maximum outside temperature.

5. A system for controlling the heating of a plurality of individual housing units in a building having a plurality of sides, the system comprising:

at least one heating unit contained in each individual housing unit for heating said individual housing unit;

a relay coupled to each heating unit for turning the heating unit on and off;

a control unit coupled to each of the relays, the control unit configured to cause the relays to turn their respective heating units on and off at a duty cycle;

at least one outside temperature sensor coupled to the control unit for measuring the temperature of the air outside the building;

at least one outside wind sensor coupled to the control unit for measuring the speed of the wind outside the building;

the control unit having an algorithm configured to decrease the duty cycle when the temperature of the air outside the building increases beyond a predefined minimum outside temperature, and the algorithm being further configured to increase the duty cycle when the speed of the wind outside the building exceeds a predefined minimum wind speed.

6. A system for controlling the heating of a plurality of individual housing units in a building having a plurality of sides, the system comprising:

at least one heating unit contained in each individual housing unit for heating said individual housing unit;

a relay coupled to each heating unit for turning the heating unit on and off;

a control unit coupled to each of the relays, the control unit configured to cause the relays to turn their respective heating units on and off at a duty cycle;

at least one outside temperature sensor coupled to the control unit for measuring the temperature of the air outside the building;

at least one outside wind sensor coupled to the control unit for measuring the speed and direction of the wind outside the building;

the control unit having an algorithm configured to decrease the duty cycle when the temperature of the air outside the building increases beyond a predefined minimum outside temperature, and the algorithm being further configured to increase the duty cycle of the heating units adjacent the side of the building in the direction of the wind when the speed of the wind exceeds a predefined minimum wind speed.

7. The system of claim 6 wherein the algorithm is farther configured to decrease the duty cycle of the heating units adjacent the side of the building opposite the direction of the wind.

8. A system for controlling the heating of a plurality of individual housing units in a building, the individual housing units being contained in a plurality of separate zones of the building, the system comprising:

at least one heating unit contained in each individual housing unit for heating said individual housing unit;

a relay coupled to each heating unit for turning the heating unit on and off;

a control unit coupled to each of the relays, the control unit configured to cause the relays to turn their respective heating units on and off at a duty cycle by applying the duty cycle to the relay;

at least one outside temperature sensor coupled to the control unit for measuring the temperature of the air outside the building;

at least one inside temperature sensor coupled to the control unit for measuring the temperature of the air inside each of the zones;

the control unit having an algorithm configured to decrease the duty cycle when the temperature of the air outside the building increases beyond a predefined minimum outside temperature, the algorithm being further configured to increase the duty cycle of the heating units in the zones when the temperature of the air in said zones drops below a predefined inside minimum;

the algorithm and the control unit being further configured to simultaneously apply different duty cycles to the relays in different zones.

* * * * *